US006761349B2

(12) United States Patent
McCraw

(10) Patent No.: US 6,761,349 B2
(45) Date of Patent: Jul. 13, 2004

(54) QUICK-SET CLAMPING MECHANISM

(76) Inventor: Brian McCraw, 4708 Ryan Ct., Reading, PA (US) 19606

( * ) Notice: Subject to any disclaimer, the term of this patent is extended or adjusted under 35 U.S.C. 154(b) by 0 days.

(21) Appl. No.: 10/378,277

(22) Filed: Mar. 3, 2003

(65) Prior Publication Data

US 2003/0173727 A1 Sep. 18, 2003

Related U.S. Application Data

(60) Provisional application No. 60/361,507, filed on Mar. 5, 2002.

(51) Int. Cl.[7] ..... B25B 1/02; B25B 5/02

(52) U.S. Cl. ..... 269/212; 269/85; 269/97; 269/172; 269/196

(58) Field of Search ..... 269/75, 197, 212, 269/239, 236, 256, 97

(56) References Cited

U.S. PATENT DOCUMENTS 636,661 A * 11/1899 Guest ..... 269/196
1,329,602 A * 2/1920 Hultberg ..... 269/85
2,788,688 A * 4/1957 Atkins ..... 269/197
3,088,729 A * 5/1963 Marcus ..... 269/97
3,758,308 A * 9/1973 Jesionowski ..... 430/553
5,531,428 A * 7/1996 Dembicks et al. ..... 269/172

* cited by examiner

*Primary Examiner*—Lee D. Wilson
*Assistant Examiner*—Daniel Shanley
(74) *Attorney, Agent, or Firm*—Law Offices of Royal W. Craig

(57) ABSTRACT

An improved clamping assembly especially suited for use in a bench vise for allowing a user to choose between conventional fine-screw-reduction closure and/or opening of the jaws for clamping, or quick-set sliding adjustment of the jaws. The clamping assembly relies on a toothed rack and pawl. The pawl is selectively engaged with the toothed rack to allow conventional reduction gear closure or opening. Alternatively, a user can more quickly open and close the jaws by disengaging the pawl from the rack and simply sliding the jaws relative to one another. The clamping assembly provides a quick-set clamping action which allows a user to initially to preset the jaws by sliding them together in one quick motion, followed by conventional fine-screw-adjustment for high-force clamping.

10 Claims, 6 Drawing Sheets

QUICK-SET CLAMPING MECHANISM

CROSS-REFERENCE TO RELATED APPLICATIONS

The present application derives priority from U.S. Provisional Application Serial No. 60/361,507 filed Mar. 5, 2002.

BACKGROUND OF THE INVENTION

1. Field of the Invention

The present invention relates to quick-set clamping mechanisms, and in particular, to an improved vise assembly which allows a user to initially to preset the jaws by sliding them together in one quick motion to save time, followed by conventional fine-screw-adjustment for clamping.

2. Description of the Background

The bench vice is an age-old tool for clamping and holding a work piece. A conventional bench vise, as shown in FIG. 1, includes a sliding jaw 12 mounted on a screw-spindle that is turned by a handle 10. The other end of the screw-spindle is pivotally anchored in a housing 18 that sits on a base 16. A stationary jaw 14 is integrally attached to the housing 18. Manually turning handle 10 moves the sliding jaw 12 toward or away from housing 18, respectively clamping or unclamping a workpiece. Although the utility and convenience of the traditional bench vise is beyond question, there is ample room for improvement. For example, if a user works on a large workpiece followed by a small one, he or she must adjust the jaws of the vice by screw-action from a wide-open position to a substantially closed one. This requires a great deal of turning effort and time.

It would be far more convenient to provide a quick-set mechanism to allow rapid opening and/or closing of the gap between the jaws. For example, when the gap between the jaws is at its largest and the user wants to clamp a small workpiece, it would be helpful to have the ability to slide the jaws together in one quick motion and thereby eliminate the need for a long hand cranking operation on the screw-spindle. On the other hand, a quick-setting adjustment capability as described would still need to work in conjunction with a conventional screw-clamping mechanism to give the user a reduction drive to exert a sufficient clamping force on the work piece without causing the two clamping mechanisms to bind up.

There have been a few prior efforts to develop clamping mechanisms that slide together. For example, U.S. Pat. No. 6,093,361 to Schad shows a clamp system in which a clamp piston 30 engages a rack 36 for reciprocating movement of a platen. Clamp piston 30 has teeth 34 that engage corresponding teeth 36 on column 24. Rotation of clamp piston serves to engage or disengage clamp piston teeth 34 from column teeth 36. However, this particular clamp design was intended for an injection molding machine, and the design is specifically adapted for this purpose.

It would be greatly advantageous to provide an improved clamping mechanism in the context of a bench vise which allows a user to rapidly open and/or close the gap between the jaws. This would allow the user to initially preset the jaws by sliding them together in one quick motion to save time, followed by conventional fine-screw-adjustment for reduction clamping.

SUMMARY OF THE INVENTION

It is, therefore, the primary object of the present invention to provide an improved quick-set clamping mechanism which allows a user to initially to preset the jaws by sliding them together in one quick motion, followed by conventional fine-screw-adjustment for high-force clamping.

It is another object to provide a vise with dual-adjustment mechanism which enables the jaws to be moved rapidly and in a single motion together, and which allows a separate clamping arrangement for moving the vise members relatively together a smaller distance to forcefully clamp the workpiece between the two jaws.

This object is achieved by providing a dual-action quick-set clamping mechanism, herein described in the context of a bench vise. The clamping mechanism includes a stationary jaw portion having a channel there through, and a toothed rack lining the channel. In addition, a slidable jaw portion includes a protruding hollow three-walled (top and two opposing side walls) beam that is inserted into the chamber of the stationary portion. A mandril having a threaded end is rotatably mounted within the hollow beam of the slidable portion. In addition, a toothed pawl having a threaded through-bore is mounted on the threaded end of the mandril. Thus, the mandril and pawl sit in the hollow of the beam of the slideable portion within the channel of said stationary jaw portion. The pawl has a bias spring for biasing the teeth of the pawl into engagement with the teeth of the rack. However, a user may quickly open or close the slidable jaw portion relative to the stationary portion by disengaging the pawl from the rack and sliding the beam of the slidable portion into (or out of) the channel of the stationary portion. Alternatively, the user may engage the pawl with the rack for screw-closing (or like opening) of the slidable portion against the stationary portion in a conventional bench-vise-like manner. This provides a quick-set clamping mechanism which allows a user to initially to preset the jaws by sliding them together in one quick motion, followed by conventional fine-screw-adjustment for high-force clamping.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
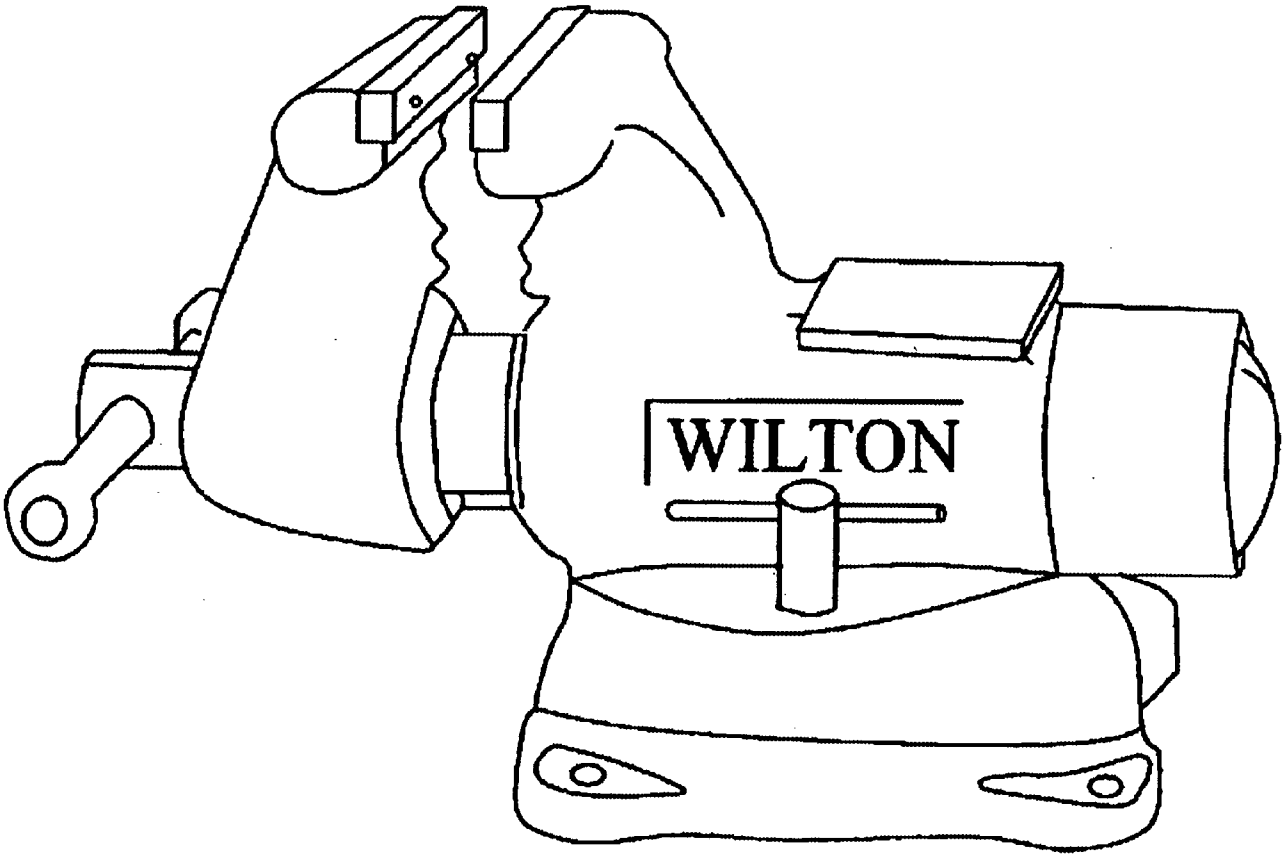
FIG. 1 Prior Art
FIG. 1 is a perspective drawing of a conventional bench vise.
Figure 2:
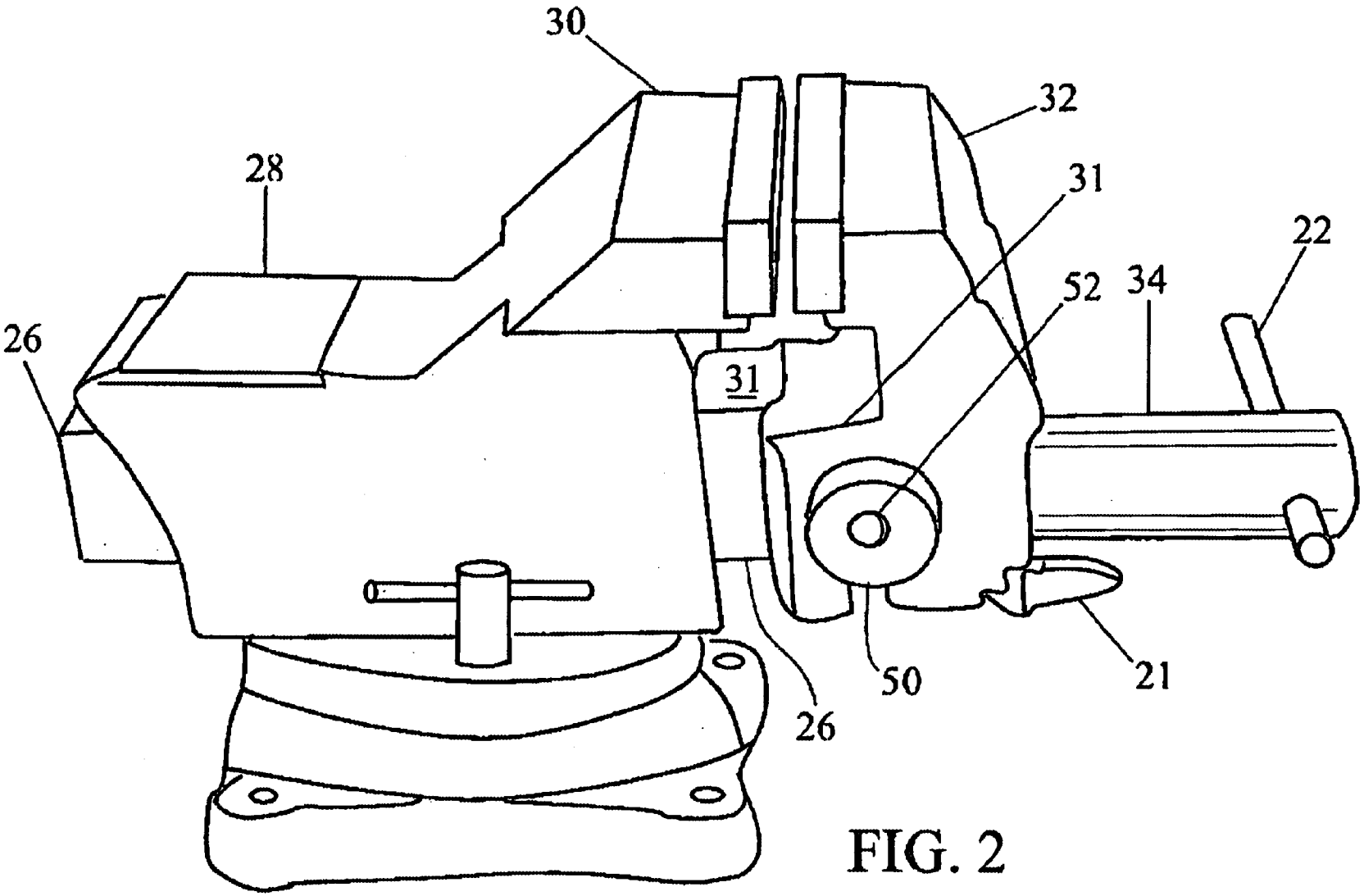
FIG. 2 is a perspective side drawing of a quick-set clamping mechanism incorporated in a bench vise according to one embodiment of the present invention.
Figure 3:
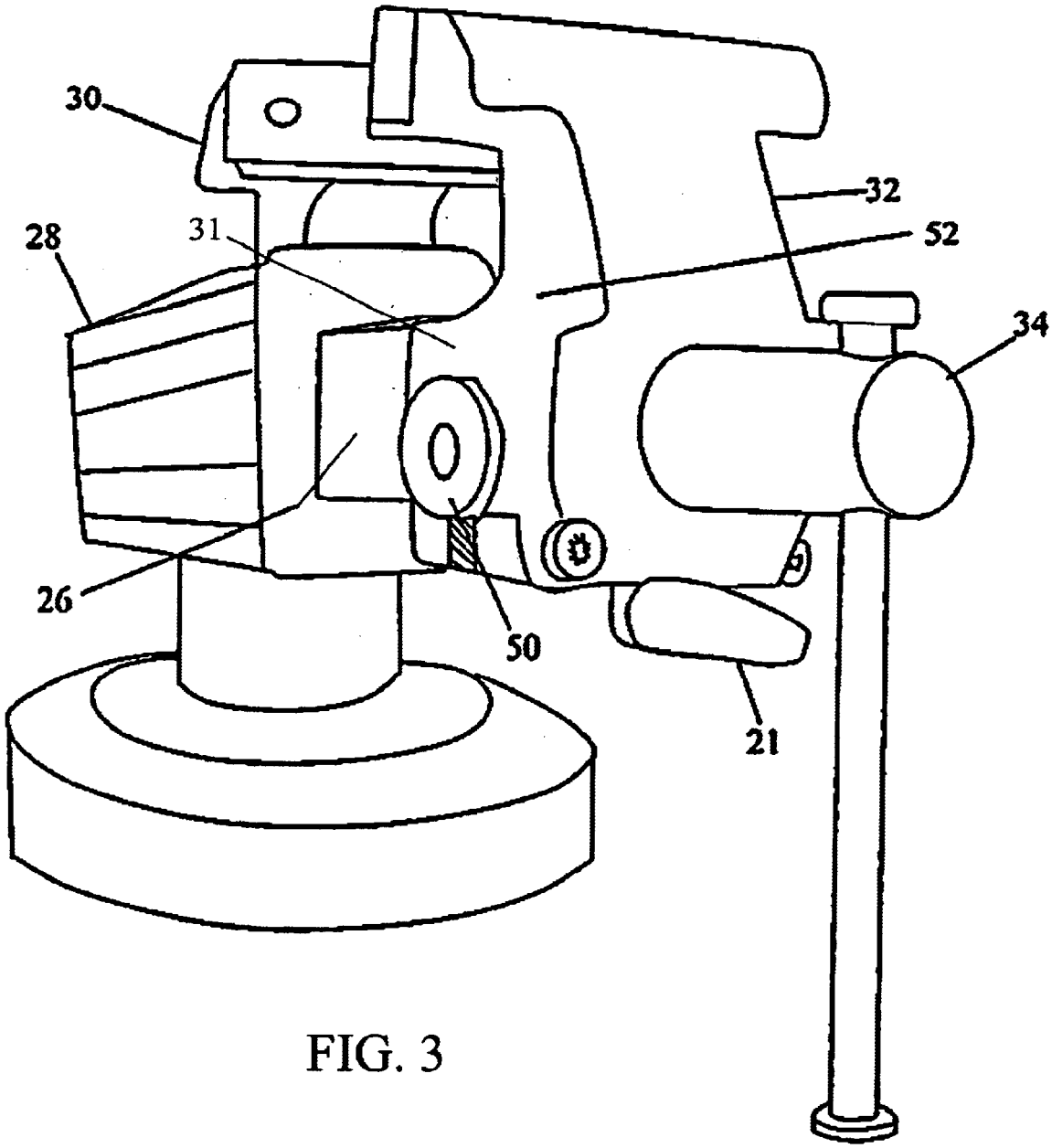
FIG. 3 is a perspective end drawing of the quick-set clamping vise as in FIG. 2.

FIG. 2 is a perspective side drawing, and FIG. 3 is a perspective end drawing, respectively, of a quick-set clamping mechanism incorporated in a bench vise according to one embodiment of the present invention.

The vise generally includes a stationary housing 28 which may be anchored to a work surface, either stationary or by articulating pedestal (as shown), in a known manner as commonly employed by existing bench vices. The stationary housing 28 supports an integral jaw 30. A slidable portion is inserted into the stationary housing, the slidable portion including a beam 26 integrally joined to a jaw 32 (jaw 32 opposing jaw 30). The clamping mechanism according to the present invention is incorporated in the foregoing components to allow a user to quickly open and/or close the jaws 30, 32, and to initially preset the jaws 30, 32 by sliding jaw 32 together in one quick motion to save time, followed by conventional fine-screw-adjustment of a threaded mandril 23 using handle 22 for clamping a workpiece between jaws 30, 32.

Figure 4:
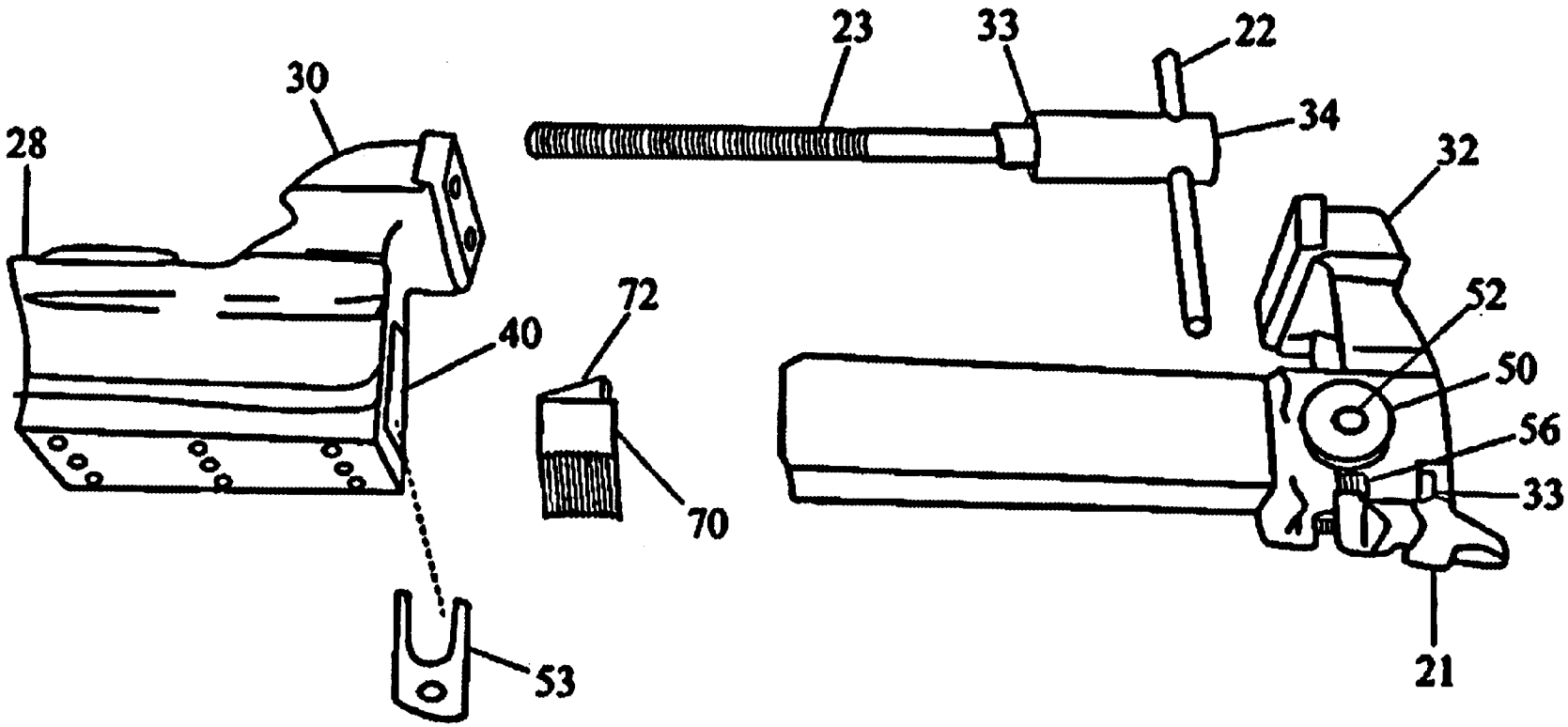
FIG. 4 is a perspective drawing of the disassembled quick-set clamping vise as in FIGS. 2 and 3.

FIG. 4 is a perspective drawing of the disassembled quick-set clamping vise as in FIGS. 2–3 showing the primary components. The stationary housing 28 with integral jaw 30 may be machined or cast from an appropriate metal or other sturdy material, and includes a rectangular channel 40 for insertion of the beam 26 of the slidable portion. A toothed rack (not seen in FIG. 3) extends along the floor of channel 40.

The beam 26 of the slidable portion is three-walled and has a rectilinear cross-section forming a hollow interior with opposing side walls (26*b* and 26*c*) and a top wall (26*a*), and is integrally connected to jaw 32 at a junction 31. The junction 31 is likewise provided with a hollow interior contiguous with that of beam 26 and opening at an aperture to the right. A pair of bushings 50*a* & 50*b* are clamped therein by respective set screws 56. When tightened, set screws 56 constrict the walls of junction 31 around the bushings 50*a* & 50*b*. Bushings 50*a* & 50*b* are annular (preferably brass or bronze) eyelet-type bushings with lateral through-bores for supporting a pivoting bearing 52 interiorly of the junction 31. The bushings 50 pivotally suspend bearing 52 across the walls of junction 31. The suspended bearing 52 rotatably captures the threaded mandril 23 therein. For this purpose, the bearing 52 is provided with a through-bore that conforms to a constricted collar 102 on mandril 23. The constricted collar 102 is rotatably captured within the bearing 52. This configuration allows the threaded barrel of mandril 23 to protrude down through the hollow beam 26 of slidable portion. A hub 34 is integrally formed at the other end of mandril 23, the hub 34 protruding outward from junction 31 to allow manual turning via handle 22. The handle 22 is inserted through a hole in the hub 34 as is well-known.

As seen in FIG. 4, an integral thumb-hold 21 protrudes outwardly from junction 31.

The threaded barrel of mandril 23 protrudes to a spring-loaded toothed pawl 70 which resides inside beam 26 of the slidable portion within channel 40 and which cooperates with the toothed rack (not seen in FIG. 2 or 3) that extends within channel 40. The pawl 70 is equipped with bias spring 72 that imparts a spring-bias against the ;underside of the top wall 26*a* of beam 26, thereby maintaining the teeth of pawl 70 in engagement with the teeth of the rack 60. A generally U-shaped jaw stop 53 is screw-attached to stationary housing 28 with prongs flanking the channel 40. The prongs are spaced to fit up inside the hollow beam 26 of slidable portion and to allow free sliding, but they catch the pawl 70, thereby limiting the outward extraction of the pawl 70 and beam 26 so that it does not fall out.

Figure 5:
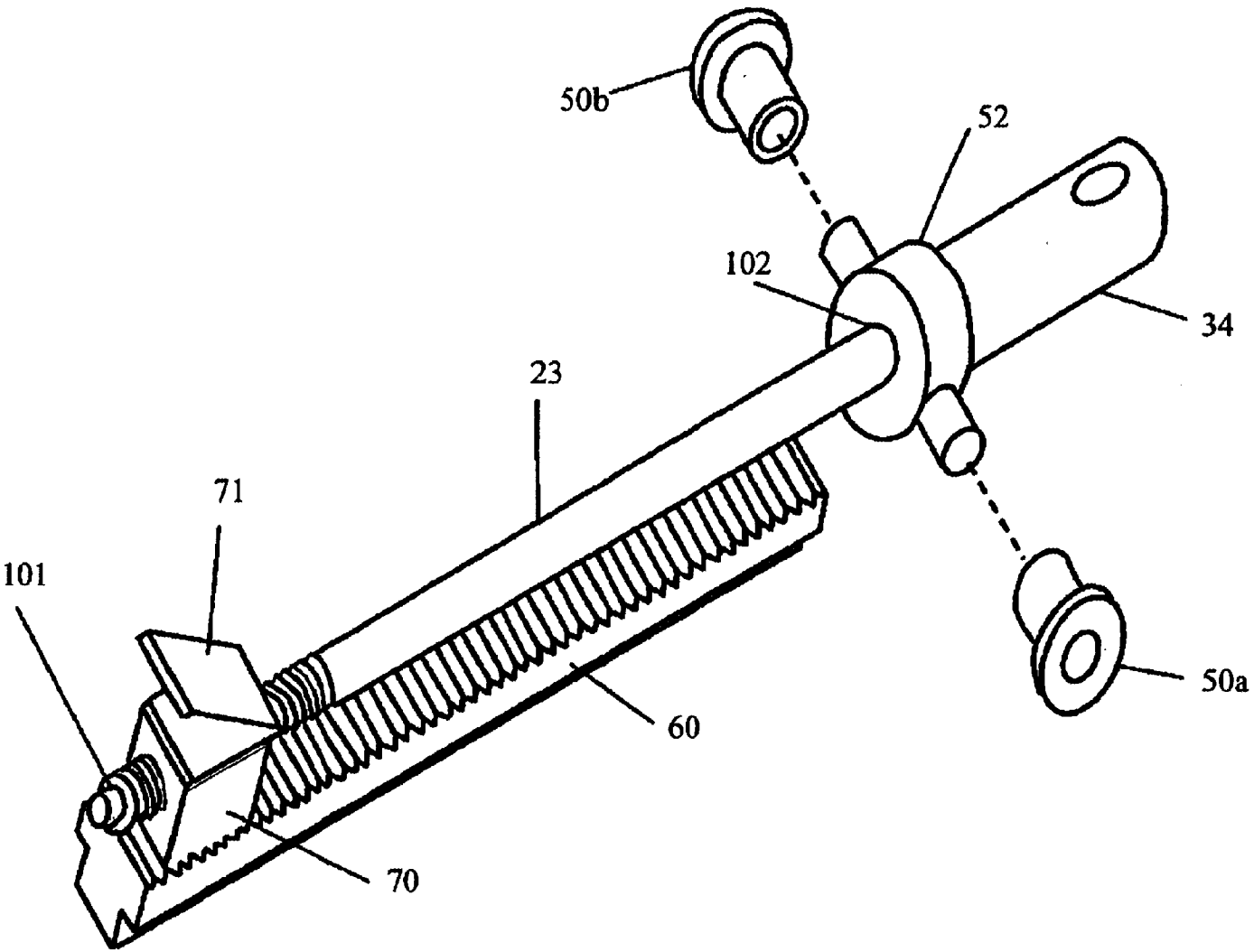
FIG. 5 is a perspective illustration of the mandril assembly of FIGS. 1–4 with spring-loaded toothed pawl 70 and toothed rack 60 extending within channel 40.

FIG. 5 is a perspective illustration of the man drill 23 assembly showing its cooperation with spring-loaded toothed pawl 70, which in turn engages the toothed rack 60 that extends with channel 40 (not shown) in housing 28.

The toothed rack 60 is an elongate section of hardened steel with upwardly disposed and forwardly oriented teeth. The pawl 70 is a generally square member of hardened steel formed with downwardly disposed and rearwardly oriented teeth, and a lateral through-bore with internal screw threads for cooperation with the threaded end of mandril 23. The teeth of rack 60 oppose those of pawl 70 and, when engaged, prevent leftward movement (viewing FIG. 5). The bias spring 72 is a bent section of spring steel that is upwardly directed against the underside of the top wall 26*a* of beam 26 which is positioned against the roof of channel 40 and thereby biases the teeth of pawl 70 into engagement with the teeth of the rack 60 along the floor of channel 40.

Bearing 52 is a collar with flanking pivot pins protruding therefrom. The pivot pins are held captive in the respective bushings 50*a* & 50*b* in the walls of junction 31. The mandril 23 passes through the bearing 52 and is rotatably seated therein. The threaded end of mandril 23 is journaled through pawl 70, and rotation of mandril 23 moves pawl 70 back or forth there along. A C-clamp retaining ring 101 is inserted onto the tip of the threaded portion of mandril 23 to prevent the pawl 70 from becoming dislodged.

Figure 6:
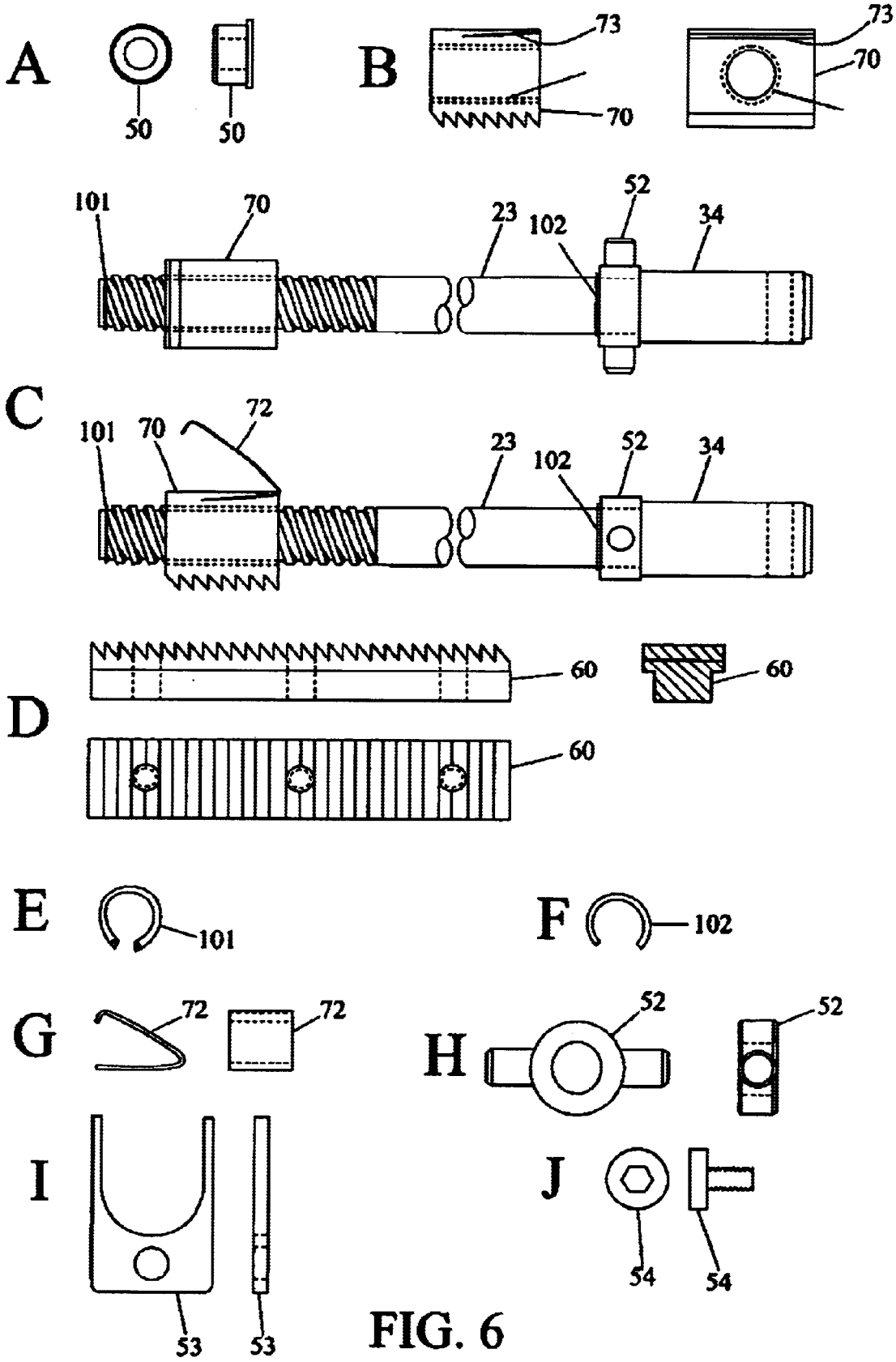
FIG. 6 is a composite illustration of the various individual components of the vise.

FIG. 6 is a composite illustration of the various individual components of the vise.

At position A, an exemplary one of the two bushings 50*a* & 50*b* is shown to be an annular ferrule-type bushing with lateral through-bore and a raised lip on one side.

At position B, the pawl 70 is a generally square member of hardened steel formed with downwardly disposed and rearwardly oriented teeth. The pawl 70 is formed with a threaded interior through-bore 74, and a lateral slot may be machined into the top of pawl 70 to anchor one leaf of bias spring 72.

At position C, the entire length of mandril 23 is shown. Mandril 23 is threaded along a distal end for screw-insertion of pawl 70 thereon. Pawl 70 rides along the threaded mandril 23. The threads of mandril 23 end and its barrel continues to the larger-diameter hub 34 with radial through-bore 75 for insertion of handle 22. Handle 22 allows convenient manual turning of the hub 34 and mandril 23 within the bearing 52.

At position D, the rack 60 is an elongate section of hardened steel with upwardly disposed and forwardly oriented teeth. The rack may be formed with a T-shaped cross-section as shown to sit within a groove in stationary housing 28. Spaced bore holes allow screw-attachment within housing 28.

At positions E and F, respectively, two retaining rings are used. The first (shown at E) is retaining ring 101 used to keep pawl 70 from coming off of the threaded end of mandril 23. The second (shown at F) is retaining ring 102 is inserted onto mandril 23 inside the bearing 52 to prevent mandril 23 from being withdrawn out of bearing 52.

At position G, an exemplary bias spring 72 is shown. The bias spring 72 is a simple piece of angled spring steel that is anchored into the back of the pawl 70 in slot 73.

At position H, an exemplary bearing 52 is shown. Bearing 52 is a annular member with through-bore and flanking pivot pins protruding on opposite sides. The mandril 23 passes through the bearing 52 and is rotatably seated therein.

At position I, a jaw stop 53 is shown. The jaw stop 53 is a U-shaped plate that is screw attached as shown in FIG. 4, prongs-up inside the beam 26 of the slidable portion. Jaw stop 53 serves to limit the outward extraction of the slidable portion so that it does not fall out.

At position J, an optional pawl stop 54 is shown. The pawl stop 54 is an alternative to the retaining ring 101, and is a simple threaded screw inserted into a threaded bore in the tip of the mandril 23. As with retaining ring 101, the head of pawl stop 54 extends radially outward from the threaded portion of mandril 23 and serves to limit the lateral motion of pawl 70, thereby ensuring that pawl 70 cannot fall off the threaded portion of mandril 23.

In operation of the above-described embodiment, the mechanism enables dual-adjustment. Beginning from a fully open position in which the jaws 30 and 32 are widespread, the user can make a course adjustment in which the jaws are moved rapidly and in a single motion together to enclose a workpiece. This is accomplished by squeezing (or lifting) the integral thumb-hold 21 and handle-end of mandril 23 (hub 34) between the thumb and forefinger. This action pivots the mandril 23 within pivoting bearing 52 about the bushings 50 interiorly of the junction 31. The threaded end 24 of mandril 23 pivots upwardly. The pawl 70, which is threadably inserted on the end of mandril 23, is lifted off of the toothed rack 60 (against the bias of spring 72). With pawl 70 disengaged, the jaw 32 can be shoved manually toward jaw 30 and the beam 26 of the slidable portion is free to telescope through the hollow interior of channel 40 (and outward through the aperture to the right, if necessary). When the jaws 30 and 32 are properly positioned, the thumb-hold 21 and the handle end of the mandril 23 (hub 34) are released and the pawl 70 snaps back down into engagement with rack 60.

With pawl 70 and rack 60 engaged, clockwise turning of handle 22 turns mandril 23, which serves as a conventional reduction drive to retract the toothed pawl 70, thereby closing and clamping the jaws 32, 34 on the work piece with proper screw-force. The pawl 70 resides inside the slidable beam 26 which in turn is slidably inserted into channel 40, and the bias spring maintains it in a normally-engaged position with the teeth of the rack 60 for reduction drive.

The foregoing configuration provides a quick-set clamping mechanism which allows a user to initially to preset the jaws 32, 34 by sliding them together in one quick motion, followed by conventional fine-screw-adjustment for high-force clamping.

Simply reversing the above-described action allows the user to open the jaws 32, 34 by the same sliding and/or screw motion.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A clamping mechanism, comprising:

a stationary housing having a first jaw, a channel through said housing, and a toothed rack lining said channel;

a slidable portion having a second jaw carried on a slidable beam inserted into the channel of said housing;

a toothed pawl having a threaded through-bore, said pawl being insertable into the channel of said housing and selectively engageable with the toothed rack lining said channel;

a mandril having a threaded end for screw-insertion into the through-bore of said pawl, said mandril being rotatably anchored to said slidable portion such that rotation of said mandril when said pawl is engaged moves said slidable portion and second jaw relative to said housing and first jaw, but disengagement of said pawl from the toothed rack lining said channel allows said slidable portion and second jaw to be slidably inserted and withdrawn from said housing without turning said mandril.

2. The clamping mechanism according to claim 1, wherein the beam of said slidable portion is a hollow beam comprising three walls including a top wall and two opposing side walls, and the mandril extends through the hollow of said beam.

3. The clamping mechanism according to claim 2, further comprising a bias spring for biasing said pawl against said top wall of the beam and into engagement with the teeth of said rack.

4. The clamping mechanism according to claim 3, wherein said bias spring is anchored in said pawl.

5. The clamping mechanism according to claim 1, further comprising a thumb-hold mounted on said slidable portion; whereby, squeezing said thumb-hold and said hub together pivotally lifts said threaded end of said mandril upwards to allow said pawl to be disengaged from said toothed rack, thereby allowing a user to shift the slidable portion relative to the housing.

6. The clamping mechanism according to claim 1, further comprising a thumb-hold mounted on said slidable portion, whereby squeezing said thumb-hold and said hub together pivotally lifts said threaded end of said mandril upwards against the bias of said bias spring to allow said pawl to be disengaged from said toothed rack, thereby allowing a user to shift the slidable portion relative to the stationary housing, and releasing said thumb-hold and said hub pivotally drops said threaded end of said mandril downwards such that the bias of said bias spring causes said pawl to reengage with said toothed rack.

7. The clamping mechanism according to claim 1, further comprising a bearing formed as a collar around said cylindrical barrel portion of said mandril with flanking pivot pins, said bearing being pivotally mounted in said slidable portion for rotatably supporting said mandril.

8. The clamping mechanism according to claim 7, further comprising opposing bushings in the slidable portion for pivotally supporting said bearing by its pivot pins.

9. The clamping mechanism according to claim 4, wherein said mandril further comprises a cylindrical barrel portion having a screw-threaded end, said barrel portion leading to a hub protruding outward from said slidable portion.

10. The clamping mechanism according to claim 9, wherein said hub has a through-bore therein for insertion of a turning handle.

* * * * *